US010241452B2

(12) United States Patent
Yamashita et al.

(10) Patent No.: US 10,241,452 B2
(45) Date of Patent: Mar. 26, 2019

(54) IMAGE FORMING APPARATUS THAT COOLS TONER CONTAINER, RECORDING SHEET, AND FIXING DEVICE

(71) Applicant: KYOCERA Document Solutions Inc., Osaka (JP)

(72) Inventors: Kazuya Yamashita, Osaka (JP); Masahiko Fukano, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 15/518,863

(22) PCT Filed: Nov. 18, 2016

(86) PCT No.: PCT/JP2016/084261
§ 371 (c)(1),
(2) Date: Apr. 13, 2017

(87) PCT Pub. No.: WO2017/086437
PCT Pub. Date: May 26, 2017

(65) Prior Publication Data

US 2018/0246445 A1 Aug. 30, 2018

(30) Foreign Application Priority Data

Nov. 20, 2015 (JP) ..... 2015-227809

(51) Int. Cl.
*G03G 21/20* (2006.01)
*G03G 15/20* (2006.01)
*G03G 21/16* (2006.01)

(52) U.S. Cl.
CPC ..... *G03G 15/2053* (2013.01); *G03G 15/2017* (2013.01); *G03G 15/2064* (2013.01); *G03G 21/16* (2013.01); *G03G 21/20* (2013.01)

(58) Field of Classification Search
CPC ..... G03G 21/206
See application file for complete search history.

(56) References Cited

U.S. PATENT DOCUMENTS 6,522,841 B2 * 2/2003 Horikoshi ..... B65H 29/14 271/211
7,469,112 B2 * 12/2008 Yuasa ..... G03G 21/206 399/92

FOREIGN PATENT DOCUMENTS

JP 2015-026087 A 2/2015

* cited by examiner

*Primary Examiner* — Walter L Lindsay, Jr.
*Assistant Examiner* — Milton Gonzalez
(74) *Attorney, Agent, or Firm* — IP Business Solutions, LLC

(57) ABSTRACT

An image forming apparatus includes an image forming unit, a fixing device, output tray, a toner container, a cooling fan, an outer wall, and a downstream branch duct. The toner container is located under the tray and beside the fixing device, and accommodates a toner. The cooling fan is located between the toner container and the fixing device. The outer wall is provided under the output tray so as to cover an upper portion of the toner container, to form an upstream duct that allows air to flow therethrough over the toner container toward the cooling fan. The downstream branch duct conducts the air discharged from the cooling fan to the fixing device, and to a transport route of the recording sheet from the fixing device to the output tray. The outer wall includes a plurality of intake holes for sucking air into the upstream duct.

18 Claims, 6 Drawing Sheets

IMAGE FORMING APPARATUS THAT COOLS TONER CONTAINER, RECORDING SHEET, AND FIXING DEVICE

TECHNICAL FIELD

The present invention relates to an image forming apparatus that forms an image on a recording sheet, and more particularly to a technique to efficiently cool a toner container, a recording sheet, and a fixing device.

BACKGROUND ART

The image forming apparatuses of this type have come to include a larger number of parts inside a limited space, owing to an increase in number of functions and reduction in size. Therefore, there is a demand for a technique to efficiently cool the inner space of the apparatus.

For example, Patent Literature (PTL) 1 discloses an apparatus including a main duct horizontally extending above a plurality of toner containers, a container cooling fan provided on the suction side of the main duct, and a sub duct connected to the main duct and extending upward. The container cooling fan blows air into the main duct so as to cool the toner containers with the air flowing through the main duct, and the air is conducted to the sub duct from the main duct thus to be discharged upward. The air blown out of the sub duct is used to cool a recording sheet heated in a fixing device and passing above the sub duct.

PTL 1 also discloses another apparatus further including, in addition to the main duct, the sub duct, and the container cooling fan, a second duct extending parallel to the main duct, and an IH cooling fan provided between the second duct and the fixing device. The container cooling fan blows air into the second duct, and the IH cooling fan blows the air conducted through the second duct to an IH coil of the fixing device, thus to cool the IH coil.

CITATION LIST

Patent Literature

[PTL 1] Japanese Unexamined Patent Application Publication No. 2015-26087

SUMMARY OF INVENTION

However, the apparatus according to PTL 1 includes the container cooling fan for cooling the toner containers and the recording sheet, and also the IH cooling fan for cooling the IH coil of the fixing device. In other words, the cooling fans are provided at two locations, to cool the respective mechanisms. This is because it is difficult to secure a sufficient air volume for cooling all of the toner containers, the recording sheet, and the IH coil, with only either of the container cooling fan and the IH cooling fan.

The present invention has been accomplished in view of the foregoing situation, and provides an image forming apparatus that enables a sufficient air volume for cooling all of the toner containers, the recording sheet, and the IH coil to be secured with a cooling fan provided at one location.

In an aspect, the present invention provides an image forming apparatus including an image forming unit, a fixing device, an output tray, a toner container, a cooling fan, an outer wall, and a downstream branch duct.

The image forming unit forms a toner image on a recording sheet.

The fixing device fixes the toner image formed by the image forming unit on the recording sheet.

The output tray receives the recording sheet which has passed the fixing device.

The toner container is located under the output tray and beside the fixing device, and accommodates a toner used for forming the toner image.

The cooling fan is located between the toner container and the fixing device.

The outer wall is provided under the output tray so as to cover an upper portion of the toner container, to form an upstream duct that allows air to flow therethrough over the toner container toward the cooling fan.

The downstream branch duct conducts the air discharged from the cooling fan to the fixing device, and the air discharged from the cooling fan to a transport route of the recording sheet from the fixing device to the output tray.

The outer wall includes a plurality of intake holes for sucking air into the upstream duct.

ADVANTAGEOUS EFFECTS OF INVENTION

In the image forming apparatus configured as above, the outer wall includes the plurality of intake holes for sucking air to the upstream duct. Accordingly, a large volume of air can be sucked into the upstream duct through each of the intake holes, and made to flow through over the toner container to the cooling fan. Therefore, a sufficient air volume for cooling all of the toner container, the recording sheet, and the fixing device can be secured, with the cooling fan provided at one location.

DESCRIPTION OF EMBODIMENTS

Hereafter, an embodiment of the present invention will be described with reference to the drawings.

Figure 1:
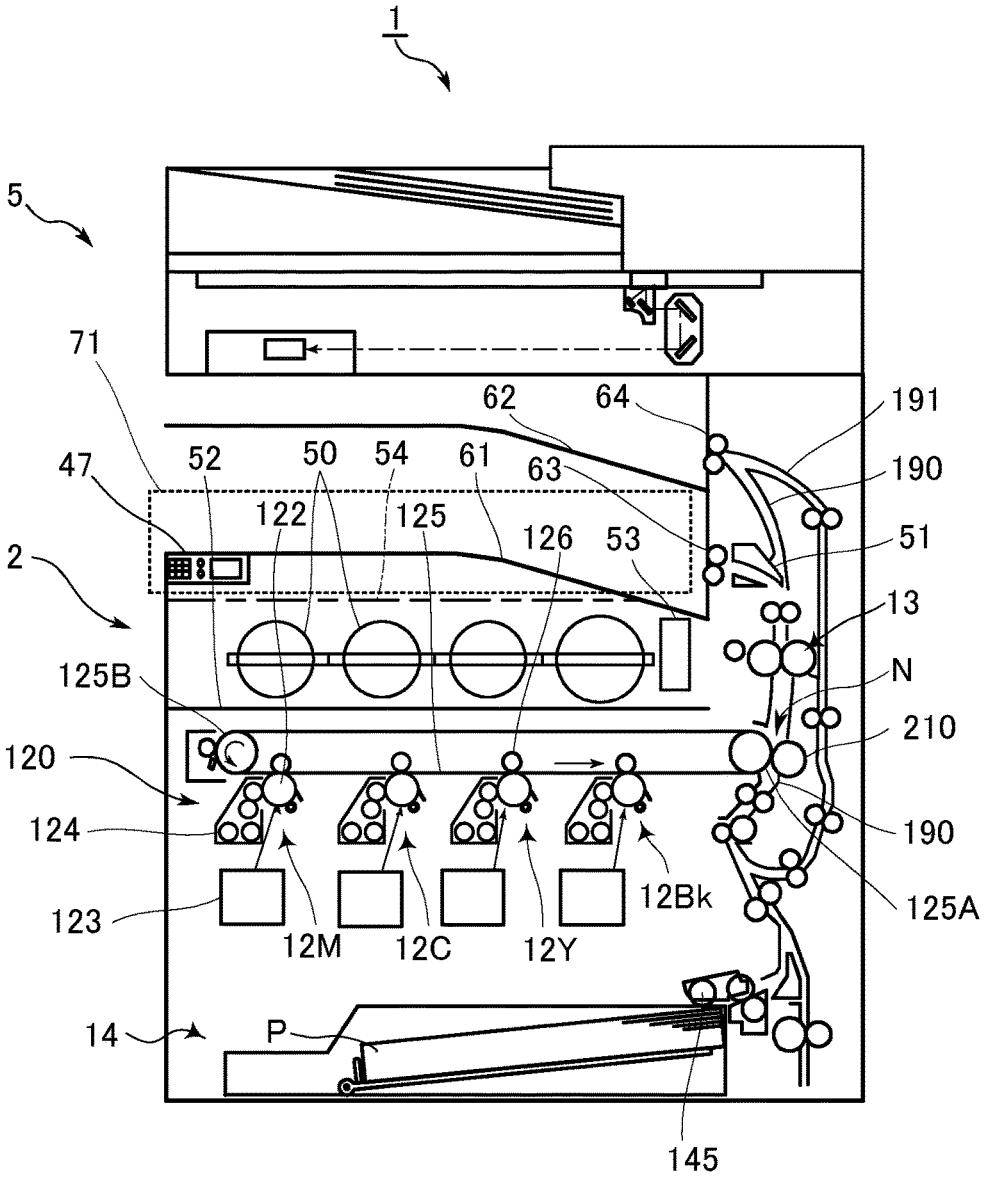
FIG. 1 is a front cross-sectional view showing a configuration of an image forming apparatus according to an embodiment of the present invention.

FIG. 1 is a front cross-sectional view showing a configuration of an image forming apparatus according to the embodiment of the present invention. As shown in FIG. 1, the image forming apparatus 1 according to this embodiment includes an image scanner unit (ISU) 5, an operation unit 47, an image forming unit 120, a fixing device 13, a paper feeding unit 14, and a plurality of toner containers 50, which are provided inside or on the main body 2.

The operation unit 47 receives instructions from the user, for operations and processes that the image forming apparatus 1 is configured to perform, such as image forming and document reading.

To perform the document reading operation, the image scanner unit 5 optically reads the image on a source document and generates image data. The image data generated by the image scanner unit 5 is stored in a built-in HDD or a computer connected to a network.

In the image forming operation, the image forming unit 120 forms a toner image on a recording medium such as a recording sheet P delivered from the paper feeding unit 14, on the basis of the image data generated through the image reading operation, image data received from a user's terminal device connected to a network, such as a computer or a smartphone, or image data stored in the built-in HDD.

The image forming unit 120 includes image forming subunits 12M, 12C, 12Y, and 12Bk, each including a photoconductor drum 122, a charging device that uniformly charges the surface of the photoconductor drum 122, a laser scanning units (LSU) 123 that exposes the surface of the photoconductor drum 122 to light so as to form an electrostatic latent image thereon, a developing device 124 that develops the electrostatic latent image on the surface of the photoconductor drum 122 into a toner image with a toner, and a primary transfer roller 126.

To perform color printing, in each of the image forming subunit 12M for magenta, the image forming subunit 12C for cyan, the image forming subunit 12Y for yellow, and the image forming subunit 12Bk for black in the image forming unit 120, the surface of the photoconductor drum 122 is uniformly charged and then exposed so as to form the electrostatic latent image representing the image of the corresponding color component. Then the electrostatic latent image on the surface of the photoconductor drum 122 is developed so as to form the toner image of the corresponding color component on the photoconductor drum 122, and the toner image is transferred, as a primary transfer process, onto an intermediate transfer belt 125 spanned around a drive roller 125A and a slave roller 125B, via the primary transfer roller 126.

The intermediate transfer belt 125 includes an image carrying surface formed on the outer circumferential surface, onto which the toner image is transferred, and is driven by the drive roller 125A, in contact with the circumferential surface of the photoconductor drum 122. The intermediate transfer belt 125 endlessly runs between the drive roller 125A and the slave roller 125B, in synchronization with the photoconductor drum 122.

The toner images of the respective colors are superposed at an adjusted timing when transferred onto the intermediate transfer belt 125, so as to form a colored toner image. A secondary transfer roller 210 transfers the colored toner image formed on the surface of the intermediate transfer belt 125, as a secondary transfer process, onto the recording sheet P transported along a transport route 190 from the paper feeding unit 14, at a nip region N of a drive roller 125A engaged with the intermediate transfer belt 125.

Then the fixing unit 13 heats the recording sheet P with pressure to thereby fix the toner image formed thereon by thermal pressing, and the recording sheet P is discharged to a first output tray 61 through a first discharge roller pair (exemplifying the discharge roller pair in CLAIMS) 63, or to a second output tray 62 through a second discharge roller pair 64. Here, the first output tray 61 is provided on the upstream side in the transport direction of the recording sheet. The second output tray 62 is provided on the downstream side in the recording sheet transport direction.

When an image is to be recorded also on the back of the recording sheet P, the recording sheet P is delivered from the second discharge roller pair 64 to a reverse transport route 191 and returned to the nip region N of the transport route 190, so that the front and back of the recording sheet P is reversed. After that, the image is recorded on the back of the recording sheet P.

The paper feeding unit 14, accommodating therein a plurality of recording sheets P, rotationally drives the pickup roller 145 so as to deliver the recording sheets P to the transport route 190.

Above the image forming unit 120, four toner containers 50 are provided. The toner containers 50 store therein the toner of magenta, cyan, yellow, and black respectively, and supply the toner to the developing device 124 of the image forming subunits 12M, 12C, 12Y, and 12Bk, through the corresponding path (not shown).

The first output tray 61 is removable mounted, and therefore a relay transport device 71 can be mounted on the image forming apparatus 1 upon removing the first output tray 61. The relay transport device 71 includes a transport route for conducting the recording sheet P, and a plurality of transport roller pairs provided along the transport route, and relays the recording sheet P discharged through the first discharge roller pair 63 to an external finisher (not shown) attached to the image forming apparatus 1. The finisher refers to what is known as a post-processing device that performs sorting, perforation, or stapling of the recording sheet P.

Figure 2:
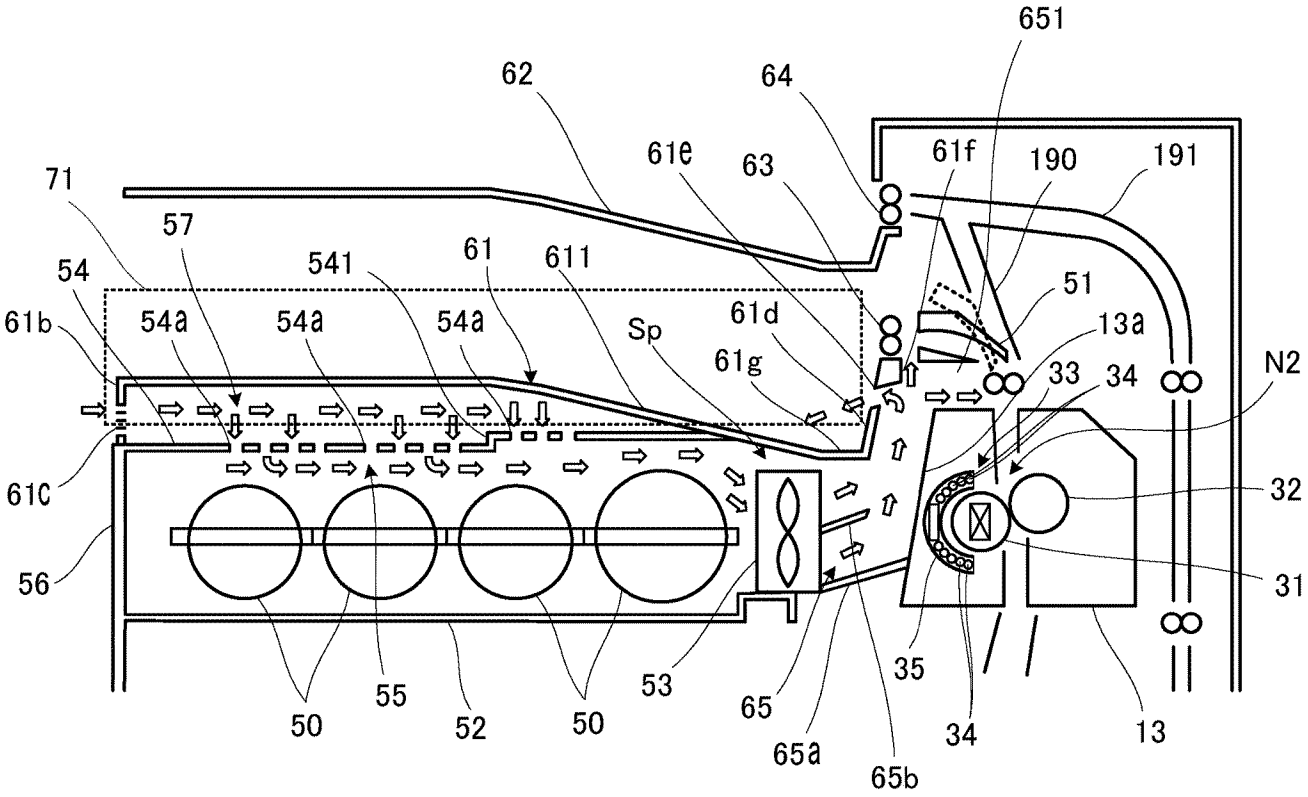
FIG. 2 is a front cross-sectional view showing a region in the vicinity of toner containers, a fixing device, a first output tray, and a second output tray.

Referring now FIG. 2, a configuration in the vicinity of the toner container 50, the fixing device 13, the first output tray 61, and the second output tray 62 will be described in detail. In FIG. 2, the fixing device 13 includes a heat roller 31, a pressure roller 32 pressed against the heat roller 31, and an IH coil unit 33 located in the vicinity of the heat roller 31. The IH coil unit 33 includes an induction-heating coil 34, a case 35, and a ferrite core, so as to heat the heat roller 31 by electromagnetic induction.

The recording sheet P is pinched in a nip region N2 between the heat roller 31 and the pressure roller 32 to be heated under pressure, so that the toner image on the recording sheet P is fixed. The recording sheet P is conducted from the fixing device 13 through a switching nail 51, to be discharged to the first output tray 61 or the second output tray 62.

The recording sheet P is discharged to the first output tray 61 through the first discharge roller pair 63. The second output tray 62 is provided above the first output tray 61, and the recording sheet P is discharged to the second output tray 62 through the second discharge roller pair 64.

The discharging of the recording sheet P to the first output tray 61 and the second output tray 62 is switched by the switching nail 51 provided in the transport route 190. The switching nail 51 is swingably supported and set to positions indicated by solid lines and broken lines in FIG. 2, by an actuator (not shown). When the switching nail 51 is switched to the position indicated by the solid lines, the recording sheet P is discharged to the first output tray 61, and when the switching nail 51 is switched to the position indicated by the broken lines, the recording sheet P is discharged to the second output tray 62.

Since the first output tray 61 is removably attached as already mentioned, the relay transport device 71 can be mounted on the image forming apparatus 1 upon removing the first output tray 61.

Each of the toner containers 50 is placed on a base plate 52 and covered with an outer wall 54, and an upstream duct 55 is formed under the outer wall 54. In a space Sp between the toner containers 50 and the fixing device 13, three cooling fans 53 are provided in a row. The upstream duct 55 forms an air passage horizontally extending from a position corresponding to the left end of the row of the toner containers 50 to the cooling fans 53. The upstream duct 55 is defined by the outer wall 54, the base plate 52, a sidewall 56, a front wall (not shown) on the side of a user, and a rear wall (not shown) on the farther side from the user.

The first output tray 61 is laid over the outer wall 54, such that a sub duct 57 is formed between the first output tray 61 and the outer wall 54. An outside wall 61*b* of the first output tray 61 includes a plurality of louvers 61*c* through which air can be sucked into the sub duct 57. The louvers 61*c* are aligned in the direction of the rotation axis of the heat roller 31 and the pressure roller 32, along which the outside wall 61*b* extends.

The outer wall 54 includes a plurality of intake holes 54*a* for sucking air from the sub duct 57 into the upstream duct 55.

The outer wall 54 also constitutes the bottom of the sub duct 57. The outer wall 54 includes a stepped portion 541 formed so as to make the downstream side of the air passage in the sub duct 57 higher than the upstream side. The stepped portion 541 is located under a sloped portion 611 inclined downward toward the downstream side in the airflow direction, formed as part of the first output tray 61 constituting the top cover of the sub duct 57.

Between the cooling fans 53 and the fixing device 13, a downstream branch duct 65 is provided. The downstream branch duct 65 forms an air passage from each of the cooling fans 53 to a sidewall 13*a* of the fixing device 13, and an air passage extending upward from the cooling fans 53 toward the first discharge roller pair 63. The downstream branch duct 65 is defined by a bottom wall 65*a*, a partition wall 65*b* generally dividing the mentioned air passages, the right end portion 61*g* and an inside wall 61*d* of the first output tray 61, the sidewall 13*a* of the fixing device 13, a front wall (not shown) on the side of the user, and a rear wall (not shown) on the farther side from the user.

The inside wall 61*d* of the first output tray 61 includes a plurality of air outlets 61*e* communicating with the downstream branch duct 65. In FIG. 2, the plurality of air outlets 61*e* are aligned in the depth direction of the sheet. Here, the first output tray 61 exemplifies the output tray in CLAIMS.

Figure 3:
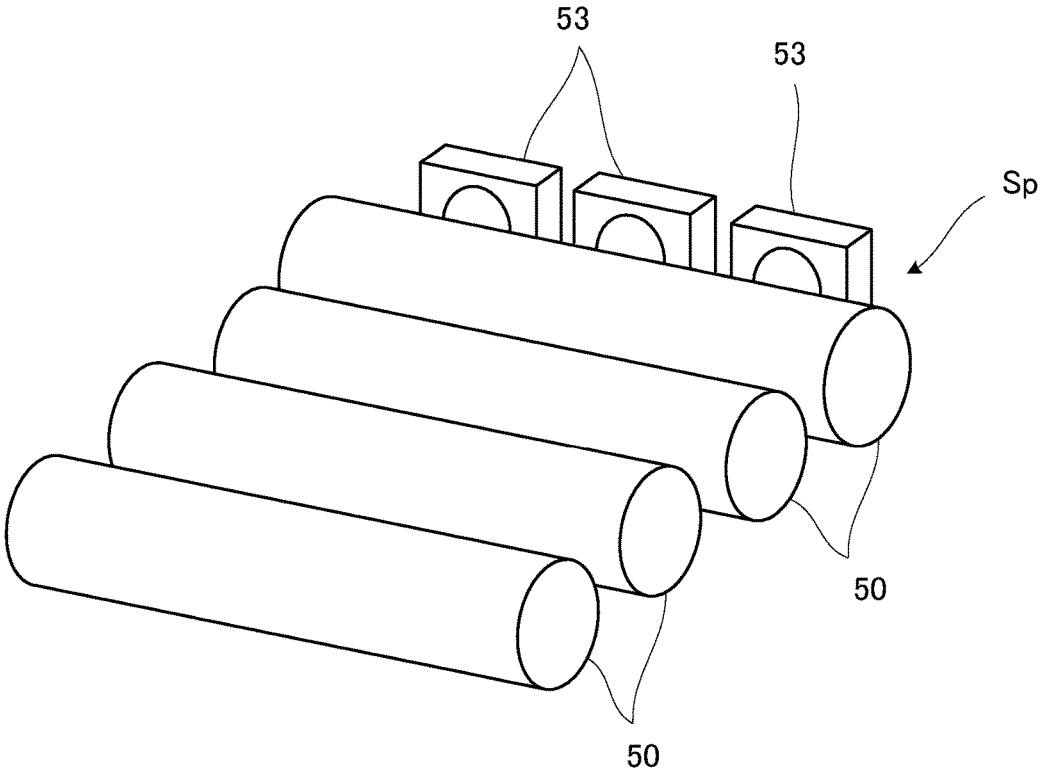
FIG. 3 is a schematic perspective view showing the toner containers and the vicinity thereof, obliquely viewed from an upper position with the first output tray, the second output tray, and an outer wall removed.

FIG. 3 is a schematic perspective view showing the toner containers 50 and the vicinity thereof, obliquely viewed from an upper position with the first output tray 61, the second output tray 62, and the outer wall 54 removed. In this embodiment, three cooling fans 53 are aligned in the space Sp between the toner container 50 and the fixing device 13 (not shown). In other words, the three cooling fans 53 are aligned in one location, which is the space Sp.

Figure 4:
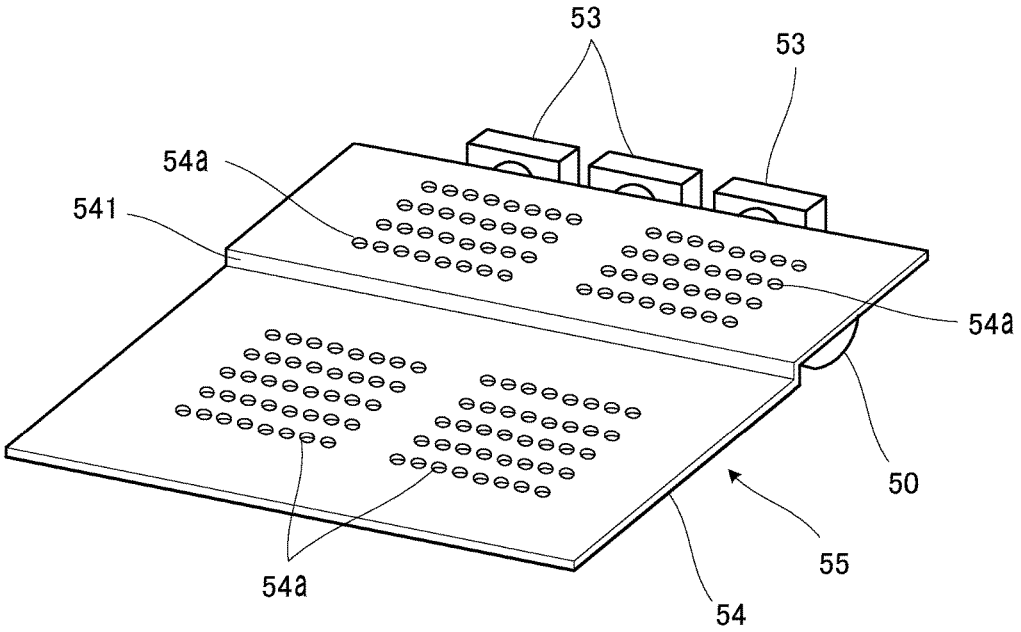
FIG. 4 is a schematic perspective view showing the outer wall and the vicinity thereof, obliquely viewed from an upper position with the first output tray and the second output tray removed.

FIG. 4 is a schematic perspective view showing the outer wall 54 and the vicinity thereof, obliquely viewed from an upper position with the first output tray 61 and the second output tray 62 removed. The outer wall 54 is located above the toner containers 50 so as to cover the same, and includes the plurality of intake holes 54*a* communicating with the upstream duct 55. As shown in FIG. 4, the intake holes 54*a* are not formed in a central region in a direction orthogonal to the direction of the airflow in the sub duct 57.

Figure 5:
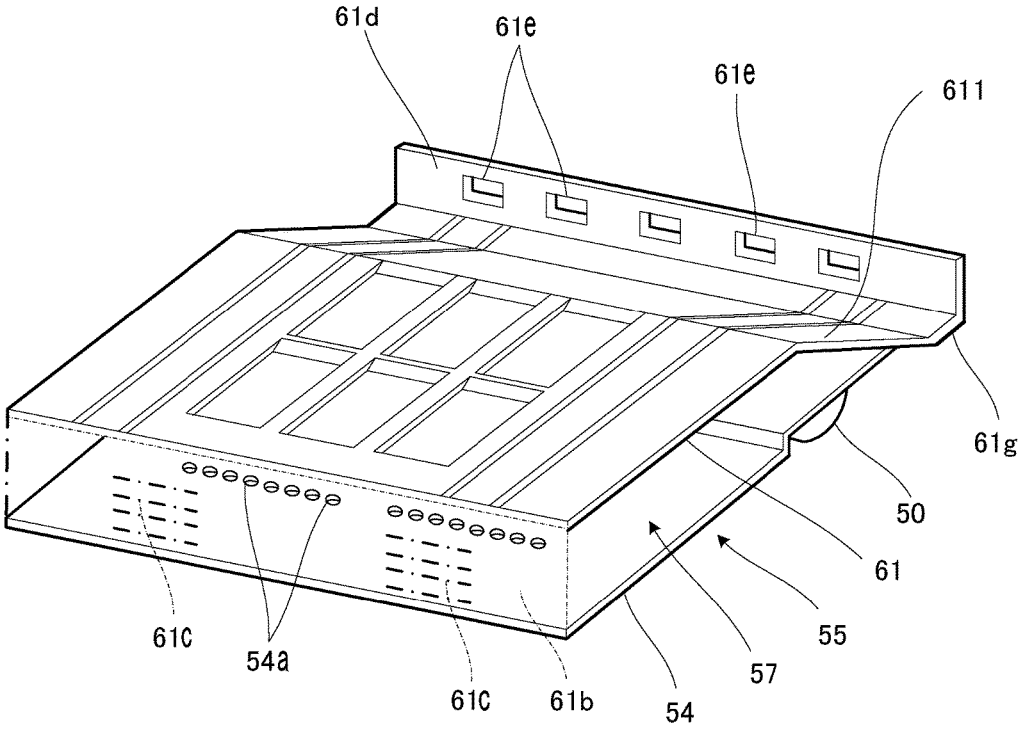
FIG. 5 is a schematic perspective view showing the first output tray and the vicinity thereof, obliquely viewed from an upper position with the second output tray removed.

FIG. 5 is a schematic perspective view showing the first output tray 61 and the vicinity thereof, obliquely viewed from an upper position with the second output tray 62 removed. FIG. 5 illustrates a part of the outer wall 54 seen through the outside wall 61*b* of the first output tray 61. The outside wall 61*b* of the first output tray 61 includes the louvers 61*c* communicating with the sub duct 57.

When the cooling fans 53 are driven under such configuration, air flows from the sub duct 57 to the upstream duct 55, and then from the upstream duct 55 to the downstream branch duct 65 via the cooling fans 53. To be more detailed, outside air flows into the sub duct 57 through the louvers 61*c* of the first output tray 61, and then flows from the sub duct 57 to the upstream duct 55 through the intake holes 54*a* of the outer wall 54, as indicated by arrows. In the upstream duct 55, as indicated by the arrows, the air flows over the toner containers 50 toward the cooling fans 53, and is sucked into the cooling fans 53. The toner containers 50 are cooled by the air flowing through the upstream duct 55, so that the temperature increase of the toner in each of the toner containers 50 is suppressed, and therefore the toner is prevented from solidifying or melting. In addition, although the recording sheet P heated in the fixing device 13 is discharged to the first output tray 61, the air flowing through the sub duct 57 and the upstream duct 55 suppresses the heat conduction from the recording sheet P on the first output tray 61 to the toner containers 50, which also contributes to suppressing the temperature increase of the toner in each of the toner containers 50.

The air blown out of the cooling fans 53 is branched to the upper region and the lower region of the partition wall 65*b* of the downstream branch duct 65 as indicated by the arrows, and the air flowing under the partition wall 65*b* collides with the sidewall 13*a* of the fixing device 13, and conducted upward along the sidewall 13*a*. The air which collides with the sidewall 13*a* of the fixing device 13 and flows upward cools the fixing device 13, and hence the IH coil unit 33 is also cooled. The lower the temperature of the induction-heating coil 34 of the IH coil unit 33 is, the higher the magnetic flux density thereof becomes, and the higher induction heating effect can be attained. Accordingly, cooling the IH coil unit 33 contributes to preventing temperature drop of the heat roller 31.

Further, the air conducted upward along the sidewall 13*a* of the fixing device 13 is merged with the air that has flowed along the upper face of the partition wall 65*b* of the downstream branch duct 65. The merged air then flows upward toward the first discharge roller pair 63. As indicated by the arrows, a part of the air flowing upward collides with a projecting guide (exemplifying the guide member) 61*f* of the inside wall 61*d* of the first output tray 61 and flows out along the upper face of the first output tray 61 through the air outlets 61*e*. Another part of the air flowing upward flows toward the first discharge roller pair 63, and still another part of the air flowing upward flows toward the transport route 190, as indicated by the arrows. Thus, the air flowing upward is branched into three directions.

The projecting guide 61*f* is formed on the first output tray 61 as part of the downstream branch duct 65. The projecting guide 61*f* branches the airflow in the downstream branch duct 65 into the flow toward the air outlets 61*e* and the flow toward the first discharge roller pair 63 located on a portion of the first output tray 61 higher than the air outlets 61*e*. The downstream branch duct 65 includes a branch path 651 that leads to a section of the transport route 190 between the fixing device 13 and the first output tray 61, formed where the air is branched by the projecting guide 61*f*. The branch path 651 is oriented to a position upstream of the first output tray 61 in the transport route 190, in the transport direction of the recording sheet.

The air that has flowed out along the upper face of the first output tray 61 through the air outlets 61*e* cools the recording sheet P discharged to the first output tray 61. The air that has flowed to the first discharge roller pair 63 cools the recording sheet P just about to be discharged to the first output tray 61. Further, the air that has flowed to the transport route 190 cools the recording sheet P that has just passed through the fixing device 13. Accordingly, the recording sheet P can be effectively cooled so that the toner on the recording sheet P is surely solidified, and therefore a plurality of recording sheets P discharged to the first output tray 61 can be prevented from sticking to each other owing to the adhesive effect of unsolidified toner. In addition, the impact of heat from the recording sheet P on the first output tray 61 on each of the toner containers 50 can be mitigated.

According to this embodiment, as described above, the outside air is introduced into the sub duct 57 through the louvers 61*c* of the first output tray 61, and then into the upstream duct 55 through the intake holes 54*a* of the outer wall 54. The outer wall 54 has a large area in a plan view, and hence a large number of intake holes 54*a* can be formed in the outer wall 54, and besides the total area of the intake holes 54*a* can be easily increased so as to minimize the air resistance in the intake holes 54*a*. Further, the intake holes 54*a* are located close to the cooling fans 53. Accordingly, a large amount of air flows into the upstream duct 55 through the intake holes 54*a*. Therefore, the large amount of air flows over the toner containers 50 so as to effectively cool the toner containers 50.

Then the large amount of air is supplied into the downstream branch duct 65 through the cooling fan 53, and then branched by the downstream branch duct 65 so as to flow toward the fixing device 13, the air outlets 61*e*, the first discharge roller pair 63, and the transport route 190. Therefore, the IH coil unit 33 of the fixing device 13 and the recording sheet P can be effectively cooled.

In conventional apparatuses, in contrast, a structure corresponding to the intake holes 54*a* of the outer wall 54 is not provided and, for example, only the louvers are provided in the sidewall 56. In this case, the distance between the louver and the cooling fans 53 is long, and besides the cross-sectional area of the upstream duct 55 is restricted from being made sufficiently large because of the reduction in size of the image forming apparatus 1. Therefore, the air suffers greater resistance when flowing from the louvers of the sidewall 56 to the cooling fans 53 and hence it is difficult to supply a large amount of air. Consequently, it is difficult to effectively cool all of the toner container 50, the IH coil unit 33, and the recording sheet P, unless cooling fans are respectively provided at a position inside the louvers of the sidewall 56 and in the space Sp between the toner container 50 and the fixing device 13, in other words at two locations.

In this embodiment, further, the first output tray 61 can be removed and the relay transport device 71 can be mounted on the image forming apparatus 1, as mentioned earlier. Although in this case the sub duct 57 becomes absent and the outer wall 54 is covered with the relay transport device 71, still a large amount of air can be introduced into the upstream duct 55 through the intake holes 54*a* of the outer wall 54.

Figure 6:
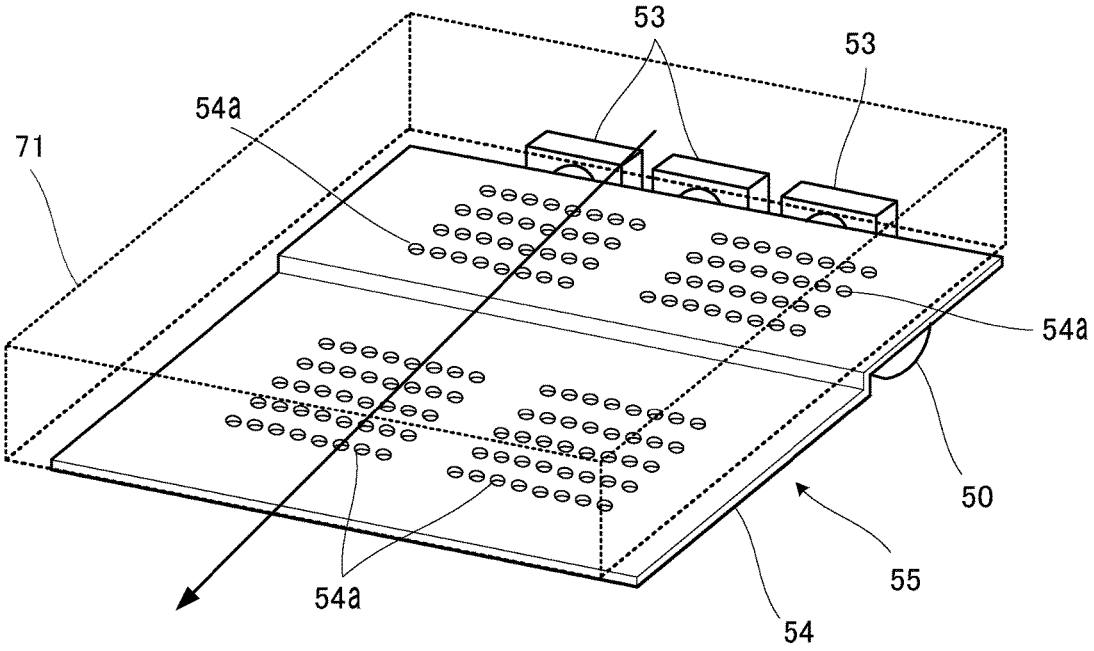
FIG. 6 is a schematic perspective view showing a relay transport device mounted on the image forming apparatus, obliquely viewed from an upper position with the first output tray removed.

FIG. 6 is a schematic perspective view showing the relay transport device 71 mounted on the image forming apparatus 1, obliquely viewed from an upper position with the first output tray 61 removed. Referring to FIG. 6, the relay transport device 71 receives the recording sheet P discharged from the first discharge roller pair 63 and transports the recording sheet P in a direction indicated by an arrow, to the finisher (not shown).

As is apparent from FIG. 6, the relay transport device 71 is laid over the intake holes 54*a* of the outer wall 54. Accordingly, a louver and a large number of holes for air to pass through are formed in the top plate and sidewalls of the casing of the relay transport device 71, as well as in the bottom plate of the casing of the relay transport device 71. Thus, the casing of the relay transport device 71 includes therein an air passage for conducting the outside air to the intake holes 54*a* of the outer wall 54 through the casing. Therefore, a large amount of air can flow into the upstream duct 55 through the intake holes 54*a* of the outer wall 54 to effectively cool the toner containers 50, and also flows into the downstream branch duct 65 through the cooling fans 53, to effectively cool the IH coil unit 33 and the recording sheet P.

Although three cooling fans 53 are aligned in the space Sp between the toner containers 50 and the fixing device 13 in the foregoing embodiment, the number of cooling fans 53 may be reduced if need be, depending on the specification of the image forming apparatus 1. For example, in the case where the processing rate in the image forming by the image forming apparatus 1 is set to a low level, the heat generation amount of the fixing device 13 is also small, and therefore the number of cooling fans 53 may be reduced.

Although the foregoing embodiment refers to the color printer as an example of the image forming apparatus according to the present invention, the present invention is equally applicable to a monochrome printer or other types of electronic apparatuses, including different types of image forming apparatuses such as a multifunction peripheral, a copying machine, and a facsimile machine.

Further, the configurations and processing according to the foregoing embodiments, described above with reference to FIG. 1 to FIG. 6, are merely exemplary and in no way intended to limit the configurations and processing of the disclosure.

The invention claimed is:

1. An image forming apparatus comprising:

an image forming unit that forms a toner image on a recording sheet;

a fixing device that fixes the toner image formed by the image forming unit on the recording sheet;

an output tray that receives the recording sheet which has passed the fixing device;

a toner container located under the output tray and beside the fixing device, and configured to accommodate a toner used for forming the toner image;

a cooling fan located between the toner container and the fixing device;

an outer wall provided under the output tray so as to cover an upper portion of the toner container, to form an upstream duct that allows air to flow therethrough over the toner container toward the cooling fan; and a downstream branch duct that conducts the air discharged from the cooling fan to the fixing device, and to a transport route of the recording sheet from the fixing device to the output tray, wherein the outer wall includes a plurality of intake holes for sucking air into the upstream duct, the image forming apparatus further comprises a sub duct formed between the output tray and the outer wall so as to conduct air introduced through an opening communicating with outside toward the upstream duct through the intake holes, the outer wall constituting a lower part of the sub duct includes a stepped portion formed so as to make a downstream side in a direction of airflow in the sub duct higher than an upstream side, and the stepped portion is located under a sloped portion inclined downward toward the downstream side in the airflow direction, formed as part of the output tray constituting a top cover of the sub duct.

2. The image forming apparatus according to claim 1, wherein an outside wall of the output tray includes a plurality of louvers through which air can be sucked into the sub duct, the louvers being aligned in a direction of a rotation axis of a heat roller and a pressure roller of the fixing device.

3. The image forming apparatus according to claim 1, wherein the downstream branch duct further includes a partition wall that divides air blown out from the cooling fan into an upper flow and a lower flow, formed at a position downstream of the cooling fan in a direction in which the air is blown out from the cooling fan.

4. The image forming apparatus according to claim 1, wherein the output tray includes an outlet communicating with the downstream branch duct so as to blow air to an upper face of the output tray.

5. The image forming apparatus according to claim 4, wherein the output tray includes, as part of the downstream branch duct, a guide member that branches an airflow in the downstream branch duct into a flow toward the outlet and a flow toward a discharge roller pair located on a portion of the output tray higher than the outlet, and the downstream branch duct includes a branch path that leads to a section of the transport route between the fixing device and the output tray, formed where air is branched by the guide member.

6. The image forming apparatus according to claim 5, wherein the output tray includes a first output tray located on an upstream side in a transport direction of the recording sheet, and a second output tray located on a downstream side in the transport direction of recording sheet, the transport route is configured to selectively transport the recording sheet from the fixing device to one of the first output tray and the second output tray, and the branch path is oriented to a position upstream of the first output tray in the transport route, in the transport direction of the recording sheet.

7. The image forming apparatus according to claim 1, wherein the plurality of intake holes are formed in the outer wall except a central region thereof in a direction orthogonal to an airflow direction in the duct.

8. The image forming apparatus according to claim 1, wherein the plurality of intake holes formed in the outer wall are located in a region thereof corresponding to the toner container.

9. The image forming apparatus according to claim 1, further comprising a relay transport device removably mounted above the outer wall when the output tray is removed, to perform relay transport of the recording sheet discharged from the fixing device, wherein the relay transport device includes an air passage or an opening for conducting air to the intake holes of the outer wall.

10. The image forming apparatus according to claim 1, further comprising a space that allows the cooling fan to be mounted, wherein one or a plurality of cooling fans are mounted in the space.

11. An image forming apparatus comprising:

an image forming unit that forms a toner image on a recording sheet;

a fixing device that fixes the toner image formed by the image forming unit on the recording sheet;

an output tray that receives the recording sheet which has passed the fixing device;

a toner container located under the output tray and beside the fixing device, and configured to accommodate a toner used for forming the toner image;

a cooling fan located between the toner container and the fixing device;

an outer wall provided under the output tray so as to cover an upper portion of the toner container, to form an upstream duct that allows air to flow therethrough over the toner container toward the cooling fan; and a downstream branch duct that conducts the air discharged from the cooling fan to the fixing device, and to a transport route of the recording sheet from the fixing device to the output tray, wherein the outer wall includes a plurality of intake holes for sucking air into the upstream duct, the output tray includes an outlet communicating with the downstream branch duct so as to blow air to an upper face of the output tray, the output tray includes, as part of the downstream branch duct, a guide member that branches an airflow in the downstream branch duct into a flow toward the outlet and a flow toward a discharge roller pair located on a portion of the output tray higher than the outlet, and the downstream branch duct includes a branch path that leads to a section of the transport route between the fixing device and the output tray, formed where air is branched by the guide member.

12. The image forming apparatus according to claim 11, wherein the output tray includes a first output tray located on an upstream side in a transport direction of the recording sheet, and a second output tray located on a downstream side in the transport direction of recording sheet, the transport route is configured to selectively transport the recording sheet from the fixing device to one of the first output tray and the second output tray, and the branch path is oriented to a position upstream of the first output tray in the transport route, in the transport direction of the recording sheet.

13. The image forming apparatus according to claim 11, wherein the downstream branch duct further includes a partition wall that divides air blown out from the cooling fan into an upper flow and a lower flow, formed at a position downstream of the cooling fan in a direction in which the air is blown out from the cooling fan.

14. The image forming apparatus according to claim 11, wherein the plurality of intake holes are formed in the outer wall except a central region thereof in a direction orthogonal to an airflow direction in the duct.

15. The image forming apparatus according to claim 11, wherein the plurality of intake holes formed in the outer wall are located in a region thereof corresponding to the toner container.

16. The image forming apparatus according to claim 11, further comprising a relay transport device removably mounted above the outer wall when the output tray is removed, to perform relay transport of the recording sheet discharged from the fixing device, wherein the relay transport device includes an air passage or an opening for conducting air to the intake holes of the outer wall.

17. The image forming apparatus according to claim 11, further comprising a space that allows the cooling fan to be mounted, wherein one or a plurality of cooling fans are mounted in the space.

18. An image forming apparatus comprising:

an image forming unit that forms a toner image on a recording sheet;

a fixing device that fixes the toner image formed by the image forming unit on the recording sheet;

an output tray that receives the recording sheet which has passed the fixing device;

a toner container located under the output tray and beside the fixing device, and configured to accommodate a toner used for forming the toner image;

a cooling fan located between the toner container and the fixing device;

an outer wall provided under the output tray so as to cover an upper portion of the toner container, to form an upstream duct that allows air to flow therethrough over the toner container toward the cooling fan; and a downstream branch duct that conducts the air discharged from the cooling fan to the fixing device, and to a transport route of the recording sheet from the fixing device to the output tray, wherein the outer wall includes a plurality of intake holes for sucking air into the upstream duct, the image forming apparatus further comprises a relay transport device removably mounted above the outer wall when the output tray is removed, to perform relay transport of the recording sheet discharged from the fixing device, and the relay transport device includes an air passage or an opening for conducting air to the intake holes of the outer wall.

* * * * *